US009076383B2

(12) United States Patent
Koyama et al.

(10) Patent No.: US 9,076,383 B2
(45) Date of Patent: Jul. 7, 2015

(54) DISPLAY DEVICE

(75) Inventors: Jun Koyama, Kanagawa (JP); Mitsuaki Osame, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 731 days.

(21) Appl. No.: 12/476,278

(22) Filed: Jun. 2, 2009

(65) Prior Publication Data

US 2009/0237390 A1 Sep. 24, 2009

Related U.S. Application Data

(62) Division of application No. 10/437,187, filed on May 14, 2003, now abandoned.

(30) Foreign Application Priority Data

May 15, 2002 (JP) ..... 2002-139445

(51) Int. Cl.
*G09G 3/32* (2006.01)
*G09G 3/20* (2006.01)

(52) U.S. Cl.
CPC ..... *G09G 3/3233* (2013.01); *G09G 3/2011* (2013.01); *G09G 3/3291* (2013.01); *G09G 2300/0842* (2013.01); *G09G 2300/0861* (2013.01); *G09G 2320/0233* (2013.01); *G09G 2320/0285* (2013.01); *G09G 2320/048* (2013.01)

(58) Field of Classification Search
None
See application file for complete search history.

(56) References Cited

U.S. PATENT DOCUMENTS 4,672,199 A 6/1987 Anderson et al.
5,027,036 A 6/1991 Ikarashi et al.
5,247,190 A 9/1993 Friend et al.

(Continued)

FOREIGN PATENT DOCUMENTS

EP 1 117 085 A2 7/2001
EP 1 160 889 A2 12/2001

(Continued)

OTHER PUBLICATIONS

C. W. Han et al., "3.8 inch Green OLED with low temperature poly Si TFT," EuroDisplay '99: Proceedings of the 19th IDRC (International Display Research Conference) Late-news papers, Sep. 6-9, 1999, Germany, pp. 27-30.

(Continued)

*Primary Examiner* — Jesus Hernandez
(74) *Attorney, Agent, or Firm* — Nixon Peabody LLP; Jeffrey L. Costellia

(57) ABSTRACT

A light emitting element has a property in which a current value is varied due to a change in temperature. A display device has a temperature compensation function in order to suppress the variation in current value dues to the change in temperature. The temperature compensation function, which is essential for the present invention has a sensor, a storage means, and a correction means. The sensor has a function of detecting an environmental temperature. The detected temperature is compared with data of voltage-current characteristic versus temperature in the light emitting element which is stored in advance in the storage means. In the correction means, a signal inputted to a pixel or a power source potential supplied to a pixel portion is corrected using an output of the sensor and the data stored in the storage means.

15 Claims, 10 Drawing Sheets

(56) References Cited

U.S. PATENT DOCUMENTS

| | | | | |
|---|---|---|---|---|
| 5,399,502 | A | 3/1995 | Friend et al. | |
| 5,608,251 | A * | 3/1997 | Konuma et al. | 257/337 |
| 5,708,451 | A | 1/1998 | Baldi | |
| 5,726,672 | A * | 3/1998 | Hernandez et al. | 345/22 |
| 5,778,146 | A | 7/1998 | Kawasaki et al. | |
| 5,936,603 | A * | 8/1999 | Lippmann et al. | 345/101 |
| 6,127,991 | A | 10/2000 | Uehara et al. | |
| 6,219,017 | B1 | 4/2001 | Shimada et al. | |
| 6,229,508 | B1 * | 5/2001 | Kane | 345/82 |
| 6,249,268 | B1 | 6/2001 | Tachibana et al. | |
| 6,456,337 | B1 | 9/2002 | Kobayashi et al. | |
| 6,473,065 | B1 | 10/2002 | Fan | |
| 6,479,940 | B1 * | 11/2002 | Ishizuka | 315/169.3 |
| 6,501,230 | B1 | 12/2002 | Feldman | |
| 6,528,951 | B2 | 3/2003 | Yamazaki et al. | |
| 6,542,260 | B1 | 4/2003 | Gann et al. | |
| 6,618,084 | B1 | 9/2003 | Rambaldi et al. | |
| 6,628,848 | B1 | 9/2003 | Nakamura | |
| 6,670,937 | B1 | 12/2003 | Tsuboyama et al. | |
| 6,677,621 | B2 | 1/2004 | Yamazaki et al. | |
| 6,753,856 | B1 | 6/2004 | Krah et al. | |
| 6,762,743 | B2 | 7/2004 | Yoshihara et al. | |
| 6,774,578 | B2 | 8/2004 | Tanada | |
| 6,803,899 | B1 | 10/2004 | Masazumi et al. | |
| 6,806,871 | B1 | 10/2004 | Yasue | |
| 6,888,529 | B2 | 5/2005 | Bruning et al. | |
| 6,911,781 | B2 | 6/2005 | Yamazaki et al. | |
| 6,963,321 | B2 | 11/2005 | Everitt | |
| 7,053,874 | B2 | 5/2006 | Koyama | |
| 7,158,157 | B2 | 1/2007 | Yamazaki et al. | |
| 7,199,771 | B2 | 4/2007 | Yamazaki et al. | |
| 2001/0020922 | A1 | 9/2001 | Yamazaki et al. | |
| 2002/0011978 | A1 * | 1/2002 | Yamazaki et al. | 345/87 |
| 2002/0033783 | A1 | 3/2002 | Koyama | |
| 2002/0044122 | A1 * | 4/2002 | Kuwata et al. | 345/88 |
| 2002/0067326 | A1 * | 6/2002 | Aoki | 345/89 |
| 2002/0101395 | A1 * | 8/2002 | Inukai | 345/83 |
| 2002/0130786 | A1 * | 9/2002 | Weindorf | 340/815.45 |
| 2002/0180672 | A1 * | 12/2002 | Yamazaki et al. | 345/77 |
| 2003/0048243 | A1 | 3/2003 | Kwasnick | |
| 2003/0063053 | A1 | 4/2003 | Yamazaki et al. | |
| 2003/0071804 | A1 | 4/2003 | Yamazaki et al. | |
| 2003/0071821 | A1 | 4/2003 | Sundahl et al. | |
| 2003/0122813 | A1 * | 7/2003 | Ishizuki et al. | 345/211 |
| 2003/0132716 | A1 | 7/2003 | Yamazaki et al. | |
| 2003/0214521 | A1 | 11/2003 | Osame et al. | |
| 2004/0004590 | A1 | 1/2004 | Lechevalier | |
| 2004/0150594 | A1 | 8/2004 | Koyama et al. | |
| 2004/0173811 | A1 | 9/2004 | Yamazaki et al. | |
| 2006/0202924 | A1 | 9/2006 | Koyama | |

FOREIGN PATENT DOCUMENTS

| | | |
|---|---|---|
| EP | 1 168 291 A2 | 1/2002 |
| JP | 61-261921 | 11/1986 |
| JP | 02-143297 | 6/1990 |
| JP | 07-122361 | 5/1995 |
| JP | 11-015437 | 1/1999 |
| JP | 11-305722 | 11/1999 |
| JP | 2001-035655 | 2/2001 |
| JP | 2001-134197 A | 5/2001 |
| JP | 2001-272968 | 10/2001 |
| JP | 2001-331144 | 11/2001 |
| JP | 2002-050484 | 2/2002 |
| JP | 2002-072964 | 3/2002 |
| JP | 2002-123217 | 4/2002 |
| JP | 2002-175041 | 6/2002 |
| JP | 2002-175046 | 6/2002 |
| JP | 2002-229513 | 8/2002 |
| JP | 2002-278514 | 9/2002 |
| JP | 2003-029710 | 1/2003 |

OTHER PUBLICATIONS

T. Shimoda et al., "Current Status and Future of Light-Emitting Polymer Display Driven by Poly-Si TFT," SID Digest '99: SID International Symposium Digest of Technical Papers, vol. XXX, May 18-20, 1999, San Jose, Cal., pp. 372-375.

T. Shimoda, et al., "High Resolution Light Emitting Polymer Display Driven by Low Temperature Polysilicon Thin Film Transistor with Integrated Driver," Asia Display '98: Proceedings of the 18th IDRC (International Display Research Conference), pp. 217-220.

* cited by examiner

DISPLAY DEVICE

BACKGROUND OF THE INVENTION

1. Field of the Invention

The present invention relates to a technique for a display device, and more specifically to a display device including a means for correcting a variation in elements resulting mainly from a change in temperature.

2. Description of the Related Art

In recent years, the development of a display device for displaying an image has been progressed. As the display device, a liquid crystal display device for displaying an image using a liquid crystal element has been widely used for a display screen of a mobile telephone by taking advantages of a high image quality, a thin form, a light weight, and the like.

On the other hand, in recent years, the development of a display device using a light emitting element has been also progressed. The display device using the light emitting element has features such as a high response speed, superior moving picture display, and a wide viewing characteristic in addition to an advantage of an existing liquid crystal display device. Therefore, the display device using the light emitting element has been noted as a next-generation compact mobile flat panel display capable of using moving picture contents.

The light emitting element contains a wide range of materials such as an organic material, an inorganic material, a thin film material, a bulk material, or a dispersion material. In those materials, as a typical light emitting element, there is an organic light emitting diode (OLED) mainly containing an organic material. The light emitting element has a structure in which an anode, a cathode, and a light emitting layer sandwiched between the anode and the cathode are provided. The light emitting layer contains one or plural materials selected from the above-mentioned materials. In general, a response speed of a material composing the light emitting layer is higher than those of a liquid crystal and the like. Therefore, time gradation method is suitable.

In the display device, a plurality of pixels each having a light emitting element and at least two transistors are provided. In each of the pixels, a transistor connected in series with the light emitting element (hereinafter indicated as a driving transistor) has a function of controlling light emission of the light emitting element. When a gate-source voltage (hereinafter indicated as $V_{GS}$) of the driving transistor and a source-drain voltage (hereinafter indicated as $V_{DS}$) thereof are changed as appropriate, the driving transistor can be operated in a saturation region or in a linear region.

When the driving transistor is operated in the saturation region ($|V_{GS}-V_{th}|<|V_{DS}|$), the amount of current flowing between both electrodes of the light emitting element is greatly dependent on a change in $|V_{GS}|$ of the driving transistor but hardly dependent on a change in $|V_{DS}|$. A driving method of operating the driving transistor in the saturation region is called constant current drive. FIG. 10A is a schematic view of a pixel to which the constant current drive is applied. In the constant current drive, the gate electrode of the driving transistor is controlled to allow the necessary amount of current to flow into the light emitting element. In other words, the driving transistor is used as a voltage control current source and set such that a constant current flows between a power source line and the light emitting element.

On the other hand, when the driving transistor is operated in the linear region ($|V_{GS}-V_{th}|>|V_{DS}|$), the amount of current flowing between both electrodes of the light emitting element is greatly dependent on both values of $|V_{GS}|$ and $|V_{DS}|$. A driving method of operating the driving transistor in the linear region is called constant voltage drive. FIG. 10B is a schematic view of a pixel to which the constant voltage drive is applied. In the constant voltage drive, the driving transistor is used as a switch, and the power source line and the light emitting element are shorted if necessary, thereby allowing a current to flow into the light emitting element.

The light emitting element has a property in which a resistance value (internal resistance value) is changed according to a change in temperature. More specifically, in the case where a room temperature is assumed to be a normal temperature, the light emitting element has the following property. When a temperature becomes higher than the normal temperature, the resistance value is reduced. On the other hand, when a temperature becomes lower than the normal temperature, the resistance value is increased. A current value flowing between both electrodes of the light emitting element is inversely proportional to the resistance value. Therefore, when the resistance value is increased, the current value is reduced. When the resistance value is reduced, the current value is increased.

FIG. 9 is a graph of voltage-current characteristic versus temperature in the light emitting element. As is apparent from the graph, even if the same voltage value is applied between both electrodes of the light emitting element, the current value depends on a temperature at a time when the display device is used (hereinafter indicated as an environmental temperature). In other words, the current value is varied according to the environmental temperature, thereby changing the brightness of the light emitting element. Therefore, an accurate gradation representation becomes difficult, so that this becomes one of the factors which impair the reliability of the display device.

SUMMARY OF THE INVENTION

The present invention has been made in view of the above-mentioned circumstances. An object of the present invention is to provide a display device to which one of constant current drive and constant voltage drive is applied and in which a variation in current value due to a change in temperature is suppressed to improve the reliability thereof.

According to the present invention, in order to suppress a variation in current value due to a change in temperature, the display device has a temperature compensation function. The temperature compensation function, which is essential for the present invention, has a group including a sensor (temperature detecting means), a storage means, and a signal correcting means or a group including a sensor (temperature detecting means), a storage means, and a voltage correcting means. The former group is applied to both the constant voltage drive and the constant current drive. The latter group is applied only to the constant voltage drive.

The sensor (temperature detecting means) has a function of detecting an environmental temperature. The detected temperature is compared with data of voltage-current characteristic versus temperature in the light emitting element which is stored in advance in the storage means. More specifically, data of a voltage-current characteristic of the light emitting element to each temperature is stored in advance in the storage means.

The correction means is broadly divided into the signal correcting means and the voltage correcting means. The signal correcting means corrects a signal inputted to a pixel using the data stored in the storage means. The voltage correcting means corrects a power source potential supplied to a pixel portion using the data stored in the storage means. Therefore, according to the environmental temperature detected by the sensor, the signal inputted to each pixel is corrected or the power source potential is corrected, so that a variation in current value due to a change in temperature is suppressed. As a result, a display device having the improved reliability can be provided.

Note that, with respect to a temperature sensor used as the sensor, a light emitting element for monitoring temperature may be used in addition to a known temperature sensor. According to the light emitting element for monitoring temperature, a constant current always flows between both electrodes thereof and a variation in resistance value of the light emitting element due to a change in temperature is detected to detect the temperature.

According to the present invention, a display device has a sensor for detecting an environmental temperature, a storage means for storing data of a change of a voltage-current characteristic along with temperature in a light emitting element, a correction means for correcting a video signal or a power source potential using an output of the sensor and the data of a change of a voltage-current characteristic along with temperature, and a connection terminal with which a display panel is connected.

According to the present invention, a display device has a connection terminal for connecting a display panel including a light emitting element with a sensor, a storage means, and a correction means. The sensor detects an environmental temperature, the storage means stores data of a change of a voltage-current characteristic along with temperature in the light emitting element, and the correction means corrects a video signal or a power source potential using an output of the sensor and the data of a change of a voltage-current characteristic along with temperature.

According to the present invention, a display device has a sensor for detecting an environmental temperature, a storage means for storing data of a change of a voltage-current characteristic along with temperature in a light emitting element, and a correction means for supplying a signal to a pixel portion, in which the correction means corrects a video signal or a power source potential using an output of the sensor and the data of a change of a voltage-current characteristic along with temperature.

According to the present invention, a display device with a display panel including a light emitting element has a sensor for detecting an environmental temperature, a storage means for storing data of a change of a voltage-current characteristic along with temperature in the light emitting element, and a correction means for correcting a video signal or a power source potential using an output of the sensor and the data of a change of a voltage-current characteristic along with temperature.

A display device according to the present invention is characterized by including: a display panel having a light emitting element; a temperature detecting means for detecting an environmental temperature; a storage means for storing data of a change of a voltage-current characteristic along with temperature in the light emitting element; and correction means for correcting one of a video signal and a power source potential in accordance with the data of a change of a voltage-current characteristic along with temperature stored in the storage means and an output of the temperature detecting means and supplying one of the corrected video signal and power source potential to the display panel.

The display device according to the present invention further includes: a cumulative light emitting period detecting means for detecting a cumulative light emitting period of each pixel using the video signal, and is characterized in that the correction means corrects the video signal using the cumulative light emitting period.

DETAILED DESCRIPTION OF THE PREFERRED EMBODIMENTS

Embodiment 1

Figure 1:
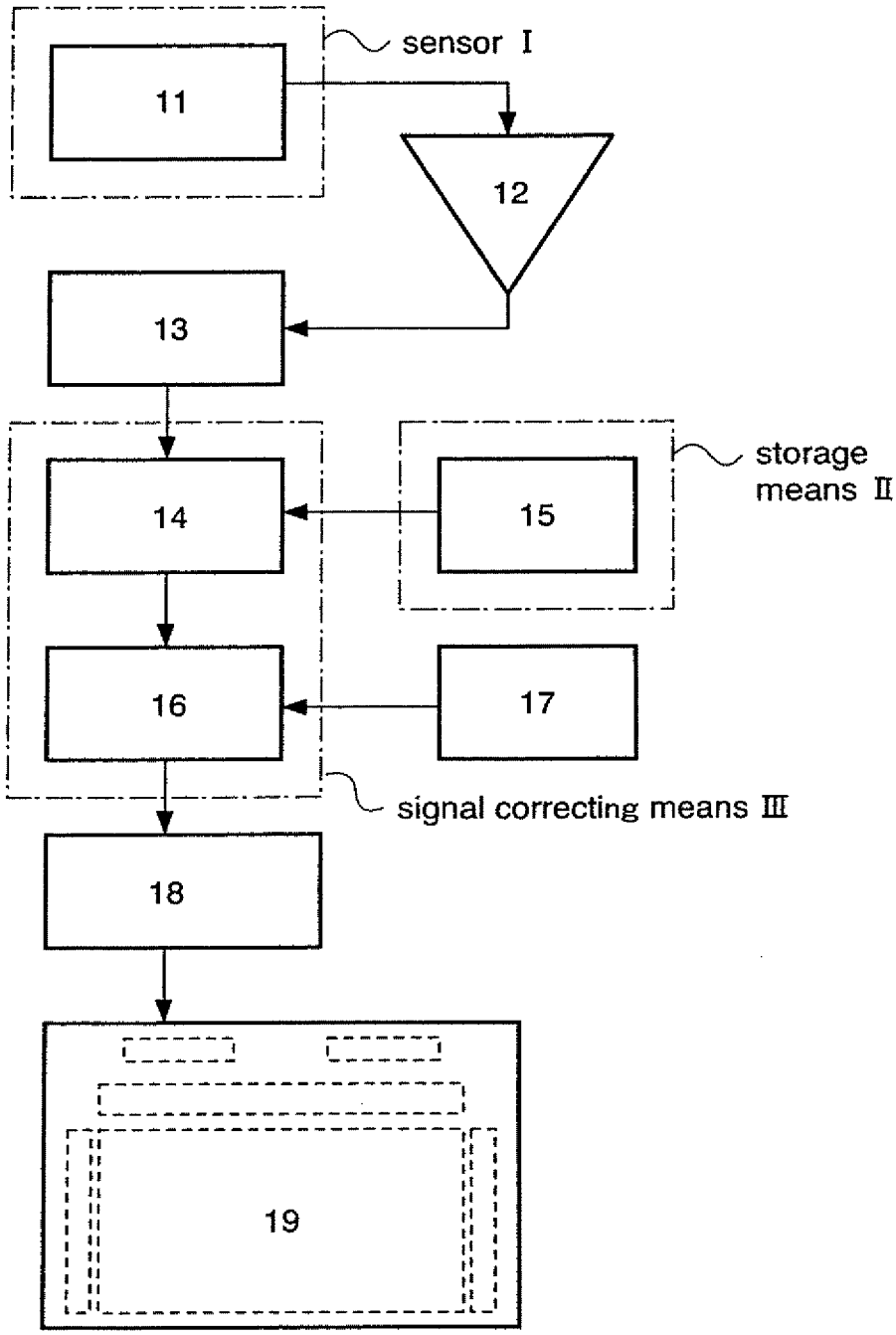
FIG. 1 shows a display device of the present invention.

A first structure and a second structure of a display device having a temperature compensation function according to the present invention will be described with reference to FIGS. 1 and 2.

The first structure of the present invention will be described with reference to FIG. 1. In FIG. 1, the temperature compensation function, which is essential for the present invention, is realized by a sensor (I), a storage means (II), and a signal correcting means (III). The sensor (I) includes a temperature sensor 11, the storage means (II) includes a temperature compensation storage circuit 15, and the signal correcting means (III) includes a correction data producing circuit 14 and a correction circuit 16. In addition, the first structure has an amplifier 12, an A/D converting circuit 13, and a sub-frame converting circuit 18.

Here, the operation of the circuit having the above-mentioned temperature compensation function will be described. First, data of a voltage-current characteristic of a light emitting element at each temperature is stored in advance in the temperature compensation storage circuit 15. The data is used as a map for signal correction by the signal correcting means (III).

When an environmental temperature is detected by the temperature sensor 11, data is supplied from the temperature sensor 11 to the amplifier 12. The data supplied from the temperature sensor 11 is amplified by the amplifier (analog amplifier) 12 and then sent to the A/D converting circuit 13. In the A/D converting circuit 13, the data supplied from the amplifier 12 is converted into digital data.

In the correction data producing circuit 14, correction data is produced using the digital data supplied from the A/D converting circuit 13 and the data stored in the temperature compensation storage circuit 15. Subsequently, in the correction circuit 16, the correction data supplied from the correction data producing circuit 14 and a video signal 17 are multiplied together to correct the video signal to a signal suitable to the environmental temperature. The corrected video signal is thus converted into a signal suitable for time gradation method by the sub-frame converting circuit 18 and finally supplied to a pixel portion 19.

Thus, by correcting the signal inputted to each pixel according to the environmental temperature detected by the temperature sensor 11, a variation in current value due to a change in temperature is suppressed, thereby providing a display device having improved reliability.

Note that, voltage data or current data is supplied to each pixel included in the pixel portion 19 according to a circuit structure and a structure of a signal line driving circuit connected to the respective pixels. When voltage data is supplied to each pixel, a signal voltage is corrected by the correcting means (III) and the corrected signal voltage is supplied to the pixel portion 19. Similarly, when current data is supplied to each pixel, a signal current is corrected by the correcting means (III) and the corrected signal current is supplied to the pixel portion 19. Note that, both constant voltage drive and constant current drive can be applied to the display device having the above structure.

Next, the second structure of the present invention will be described with reference to FIG. 2. In FIG. 2, the temperature compensation function, which is essential for the present invention, is realized by the sensor (I), the storage means (II), and a voltage correcting means (III). The sensor (I) includes the temperature sensor 11, the storage means (II) includes the temperature compensation storage circuit 15, and the signal correcting means (III) includes the correction data producing circuit 14, a D/A converting circuit 20, and a power source 22. In addition, the temperature compensation function has the amplifier 12, the A/D converting circuit 13, and the sub-frame converting circuit 18.

Here, the operation of the circuit having the above-mentioned temperature compensation function will be described. Note that, because the operation of the display device shown in FIG. 2 is conducted based on the operation of the display device shown in FIG. 1, it is to be preferably referred to as appropriate.

First, data of the voltage-current characteristic of the light emitting element at each temperature is stored in advance in the temperature compensation storage circuit 15. The data is used as a map for correction of a power source potential by the voltage correcting means (III).

When an environmental temperature is detected by the temperature sensor 11, data is supplied from the temperature sensor 11 to the amplifier 12. The data supplied from the temperature sensor 11 is amplified by the amplifier (analog amplifier) 12 and then sent to the A/D converting circuit 13. In the A/D converting circuit 13, the analog data supplied from the amplifier 12 is converted into digital data.

In the correction data producing circuit 14, correction data is produced using the digital data supplied from the A/D converting circuit 13 and the data stored in the temperature compensation storage circuit 15. The produced correction data is converted into analog data again by the D/A converting circuit 20. Then, in the power source 22, the analog data supplied from the D/A converting circuit 20 and a reference voltage 21 are calculated (added), so that a potential of the power source 22 can be corrected to a potential corresponding to the environmental temperature.

Thus, by using the power source 22 whose potential is corrected to a potential corresponding to the environmental temperature as a power source for the pixel portion 19, a variation in current value due to a change in temperature can be suppressed. Note that, only the constant voltage drive can be applied to the display device having the above structure.

Figure 2:
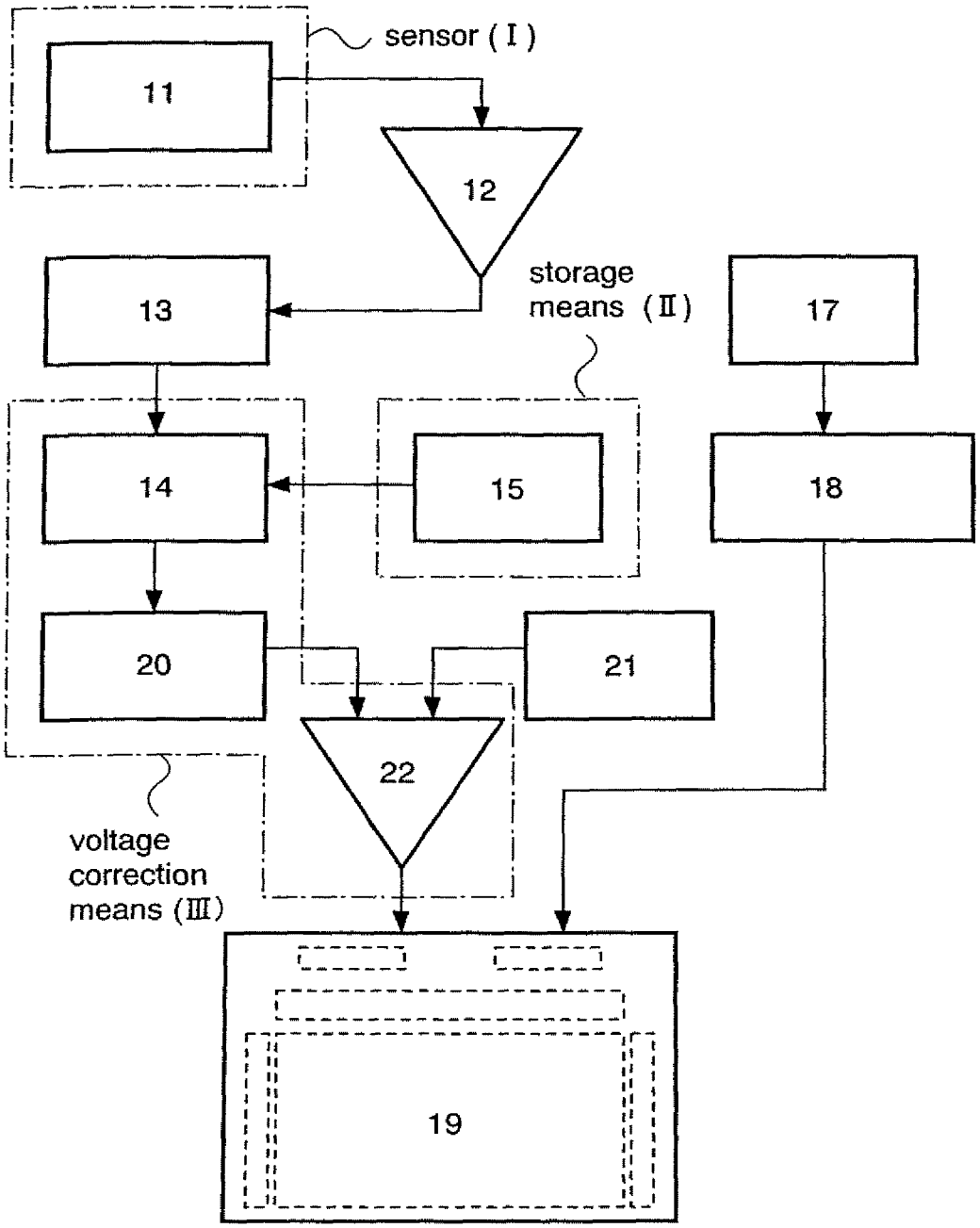
FIG. 2 shows a display device of the present invention.

In the structures shown in FIGS. 1 and 2, the circuits except for the pixel portion 19 may be integrally formed with the pixel portion 19 or connected to the pixel portion 19 as an external IC using an FPC or the like. In addition, known structural circuits can be used as circuits such as the temperature sensor 11, the amplifier 12, and the like. Further, a known storage circuit is preferably used as the temperature compensation storage circuit 15, and both a volatile memory and a nonvolatile memory can be used therefor. In view of its characteristic, it is preferable that the nonvolatile memory is used. As the nonvolatile memory, there are given a ROM, an MROM, an FPROM, an EPROM, an EEPROM, and the like. However, according to a type of the nonvolatile memory to be used, there is the case where the addition of a periodic refresh function is required. In such a case, a specific circuit is preferably incorporated in the temperature compensation storage circuit 15.

With the present invention having the above structure, the signal or the power source potential is corrected according to the environmental temperature detected by the temperature sensor to suppress a variation in current value due to a change in temperature, thereby enabling provision of a display device. In addition, in the present invention, the operation by a user is not required. Therefore, the correction is continued even after the display device is transferred to an end user, which means that the long life of a product can be expected.

Embodiment 2

In this embodiment, a display device to which a function of compensating deterioration with time is added will be described with reference to FIG. 3.

A light emitting element has a property in which a resistance value is increased according to a change with time. In other words, a current value of the light emitting element is reduced according to a change with time, thereby changing brightness of the light emitting element. The display device of this embodiment copes with such a change with time. Specifically, a counter 26 and a time compensation storage circuit 29 are added to the storage means (II) in FIGS. 1 and 2.

Figure 3:
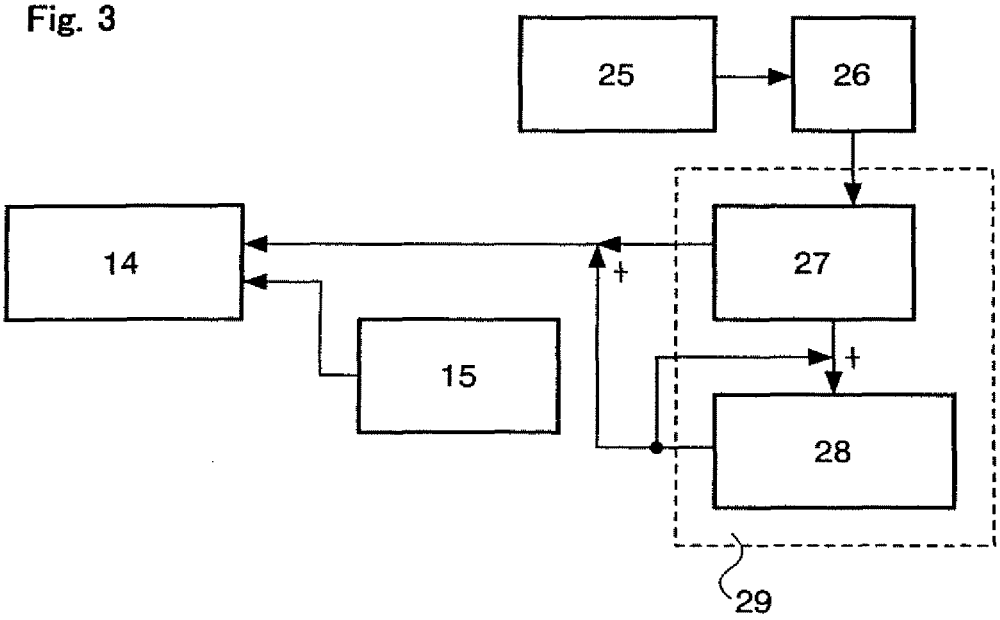
FIG. 3 shows a display device of the present invention.

In FIG. 3, data of the change of a brightness characteristic related to the light emitting element is stored in advance in the time compensation storage circuit 29. The stored data is used as a map for correction by the correcting means (III).

The counter 26 samples a video signal 25 inputted to each pixel and detects a light emitting period of each pixel according to the video signal. The light emitting period detected here in each pixel is successively stored in the time compensation storage circuit 29. Because the light emitting period is accumulated, it is desirable that the time compensation storage circuit 29 includes a nonvolatile memory 28. However, the number of writings into the nonvolatile memory 28 is generally limited. Therefore, storing using a volatile memory 27 may be conducted while the display device is operated, and writing into the nonvolatile memory 28 may be conducted for every predetermined period In this structure, a light emitting period of each pixel can be detected by sampling the video signal inputted to each pixel. A detection value detected by the counter 26 and the data of a change with time in the brightness characteristic which is stored in advance are compared with each other, and a signal or a power source potential is corrected. With this structure, the cumulative light emitting period of each pixel can be detected. Accordingly, when the cumulative light emitting period is used, the display device can cope with change with time in not only the entire pixel portion but also in each pixel.

Also, when an analog gradation method is applied, a gradation representation in the pixel portion 19 is conducted by controlling a light emitting intensity. Even in this case, it is preferable that both the light emitting period and the light emitting intensity of each pixel are detected by sampling the video signal inputted to each pixel and a deterioration state of the light emitting element is determined from both the light emitting period and the light emitting intensity.

With the present invention having the above structure, the signal or the power source potential is corrected according to not only the change in temperature but also the change with time to suppress a variation in current value due to both the change in temperature and the change with time, thereby enabling provision of a display device having improved reliability. In addition, in the present invention, the operation by a user is not required. Therefore, the correction is continued even after the display device is transferred to an end user, which means that the long life of a product can be expected.

Also, with the present invention having the above structure, the video signal supplied to a deteriorated pixel can be corrected. Accordingly, even if a part of pixels in the pixel portion is deteriorated, the uniformity of a display screen can be kept without causing uneven brightness.

Embodiment 3

According to the present invention, the temperature sensor for detecting the environmental temperature is an essential constituent element. In this embodiment, an example in which a light emitting element is used as the temperature sensor 11 will be described with reference to FIG. 4.

Figure 4:
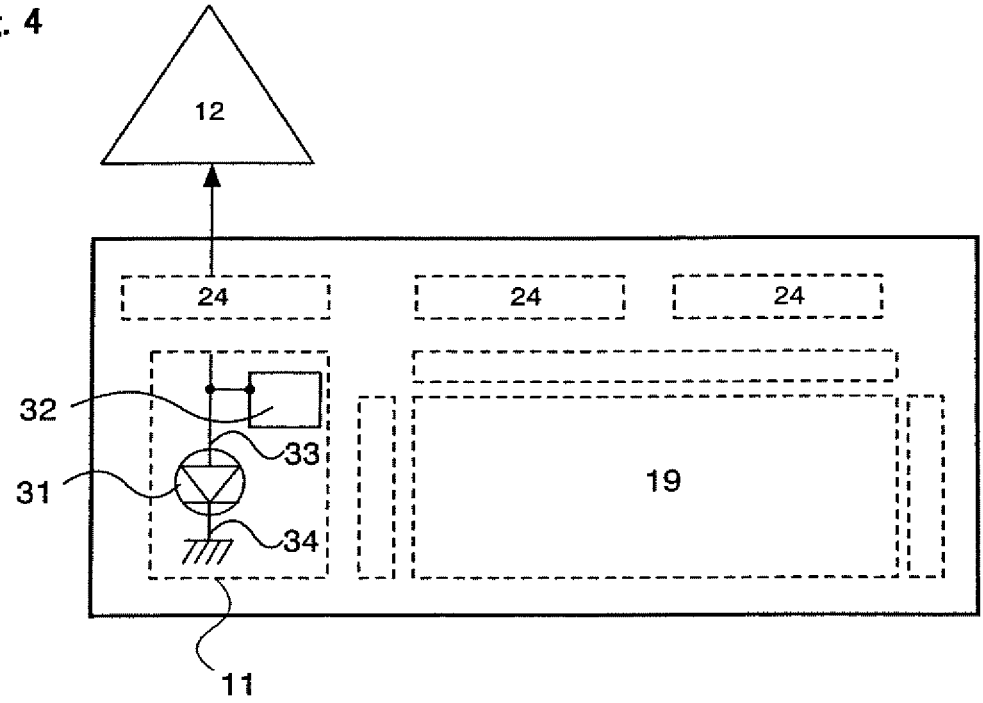
FIG. 4 shows a display device of the present invention.

FIG. 4 shows the temperature sensor 11, the amplifier 12, and the pixel portion 19 in FIGS. 1 and 2. The temperature sensor 11 has a light emitting element 31 for monitoring (hereinafter indicated as a light emitting element 31) and a constant current source 32. One electrode 34 of the light emitting element 31 is grounded and the other electrode 33 is connected to the constant current source 32 and an FPC 24.

Here, a mechanism for detecting the environmental temperature by the light emitting element 31 will be described. Because the constant current source 32 is connected with the light emitting element 31, a constant current always flows between both electrodes thereof. In other words, a current value of the light emitting element 31 is always constant. When the environmental temperature is changed in this state, a resistance value of the light emitting element 31 itself is changed. At this time, because the current value of the light emitting element 31 is always constant, a potential difference between both electrodes of the light emitting element 31 is changed, and the change in potential difference of the light emitting element 31 due to the change in temperature is detected, thereby detecting a change in environmental temperature. More specifically, because a potential of the grounded electrode 34 is not changed, a change in potential of the electrode 33 connected to the constant current source 32 is detected. The change in potential of the electrode 33 is supplied to the amplifier 12 through the FPC 24 and then supplied to the correcting means (III). Accordingly, as described above, the signal or the power source potential can be corrected according to the change in temperature. As a result, a variation in current value due to the change in temperature is suppressed, thereby providing a display device having improved reliability.

Note that although the temperature sensor 11 is integrally formed with the pixel portion 19 on the same substrate, the present invention is not limited to this. The temperature sensor 11 may be externally formed as an IC instead of being integrally formed. In addition, the temperature sensor 11 is not limited to the light emitting element, and a known temperature sensor can be used.

With the present invention having the above structure, the signal or the power source potential is corrected according to the environmental temperature detected by the temperature sensor to suppress a variation in current value due to the change in temperature, thereby providing a display device having improved reliability.

This embodiment can be arbitrarily combined with Embodiments 1 and 2.

Embodiment 4

In this embodiment, the operation in a set of the storage means (II) and the signal correcting means (III) or a set of the storage means (II) and the voltage correcting means (III), which is essential for the present invention, will be described with reference to FIGS. 5A to 5F.

Figure 5A:
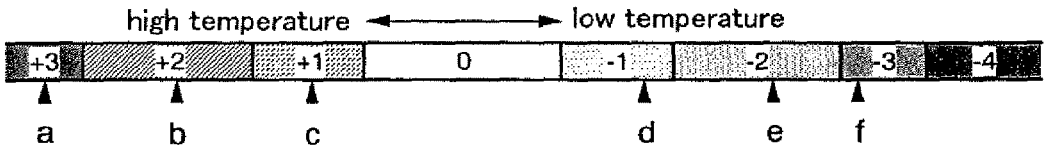
FIG. 5A to 5F are explanatory views of operation of the display device of the present invention.
Figure 5B:
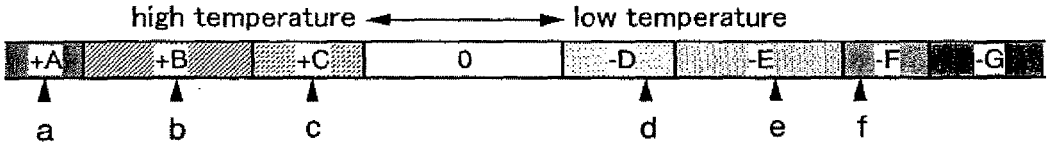
Figure 5C:
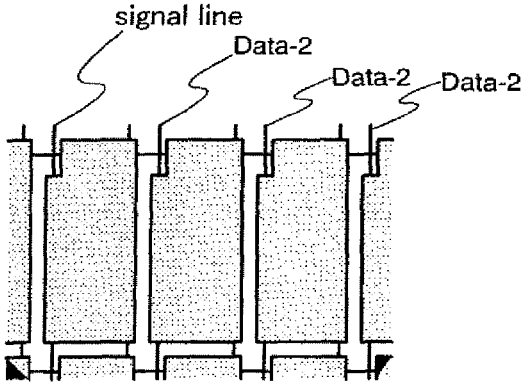

First, the operation in the storage means (II) and the signal correcting means (III) as shown in FIG. 1 will be described with reference to FIGS. 5A and 5C. FIG. 5A shows a map in which the amount of correction corresponding to a change in temperature is set. This map is produced based on measurement data of voltage-current characteristic versus temperature in the light emitting element which is measured in advance.

Numerals of −4 to +3 as shown in FIG. 5A indicate the amount of corrections corresponding to a video signal. In other words, when a temperature becomes higher, a resistance value becomes lower and a current value is increased. Therefore, one of numerals −4 to −1 is added to reduce the number of gradations of the video signal. Similarly, when the temperature becomes lower, the resistance value becomes higher and the current value is reduced. Therefore, one of numerals +1 to +3 is added to increase the number of gradations of the video signal.

For example, when the temperature reaches the level of b, 2 is always added to the video signal inputted to each pixel, so that the video signal is corrected to a signal in which brightness is increased by 2 gradations. Similarly, as shown in FIG. 5C, when the temperature reaches the level of e, −2 is always added to the video signal supplied to the signal line of each pixel, so that the video signal is corrected to a signal in which brightness is reduced by 2 gradations.

Figure 5D:
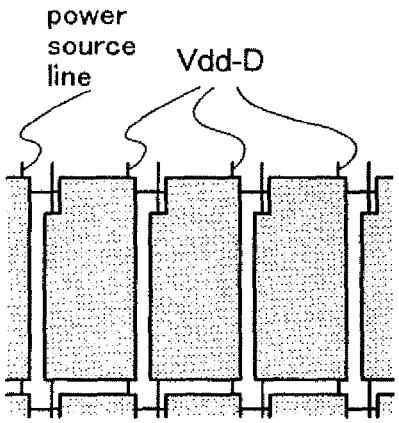

Next, the operation in the storage means (II) and the voltage correcting means (III) as shown in FIG. 2 will be described with reference to FIGS. 5B and 5D. Alphabets of +A to +C and −D to −G as shown in FIG. 5B indicate the amount of corrections to a power source potential. In other words, when the temperature becomes higher, the resistance value becomes lower and the current value is increased. Therefore, one of alphabets −D to −G is added to reduce the power source potential. Similarly, when the temperature becomes lower, the resistance value becomes higher and the current value is reduced. Therefore, one of alphabets +A to +C is added to increase the power source potential.

For example, when the temperature reaches the level of b, +B is added to the power source potential to increase the current value. Similarly, as shown in FIG. 5D, when the temperature reaches the level of d, the value of −D is added to a potential $V_{dd}$ of the power source line to reduce the current value.

Thus, in the signal correcting means (III), the signal is corrected using the data stored in advance in the storage means (II). Similarly, in the voltage correcting means (III), the power source potential is corrected using the data stored in advance in the storage means (II).

Next, the operation in a set of the storage means (II) and the signal correcting means (III) or the voltage correcting means (III) when both the temperature compensation function and the time compensation function are provided as shown in FIG. 3 will be described with reference to FIGS. 5E and 5F.

Figure 5E:
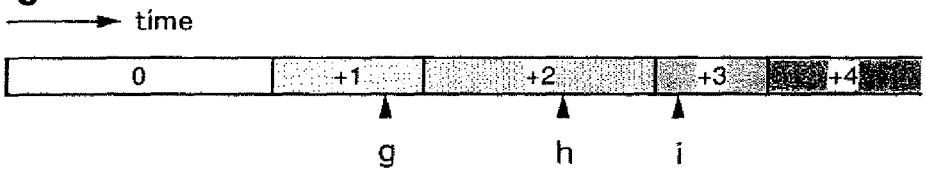
Figure 5F:
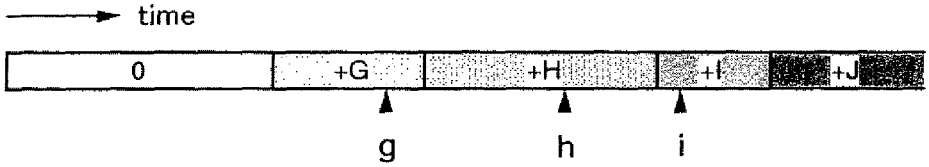

FIGS. 5E and 5F show respective maps in which the amount of correction to a change with time is set. These maps are produced based on measurement data of voltage-current characteristic versus time in the light emitting element, which is measured in advance.

Numerals of +1 to +3 as shown in FIG. 5E indicate the amount of corrections to a video signal. When the light emitting element is influenced by the change with time, the resistance value becomes higher and the current value is reduced. Therefore, one of numerals +1 to +3 is added to increase the number of gradations of the video signal.

For example, when the temperature reaches the level of e and the change with time reaches the level of g, (−2)+(+1)=−1 is always added to the video signal inputted to each pixel, so that the video signal is corrected to a signal in which brightness is reduced by 1 gradation.

Also, when the temperature reaches the level of e and the change with time reaches the level of g, (−E)+(G) is added to the power source potential for correction.

According to the present invention with the above structure, when the signal or the power source potential is corrected according to the environmental temperature detected by the temperature sensor, a variation in current value due to the change in temperature is suppressed, thereby providing a display device having improved reliability. In addition, according to the present invention, the operation by a user is not required. Therefore, when the correction is continued after the display device is transferred to an end user, the long life of a product can be expected.

This embodiment can be freely combined with Embodiments 1 to 3.

Embodiment 5

In this embodiment, an outline of a display device of the present invention will be described with reference to FIGS. 6A to 6C.

Figure 6A:
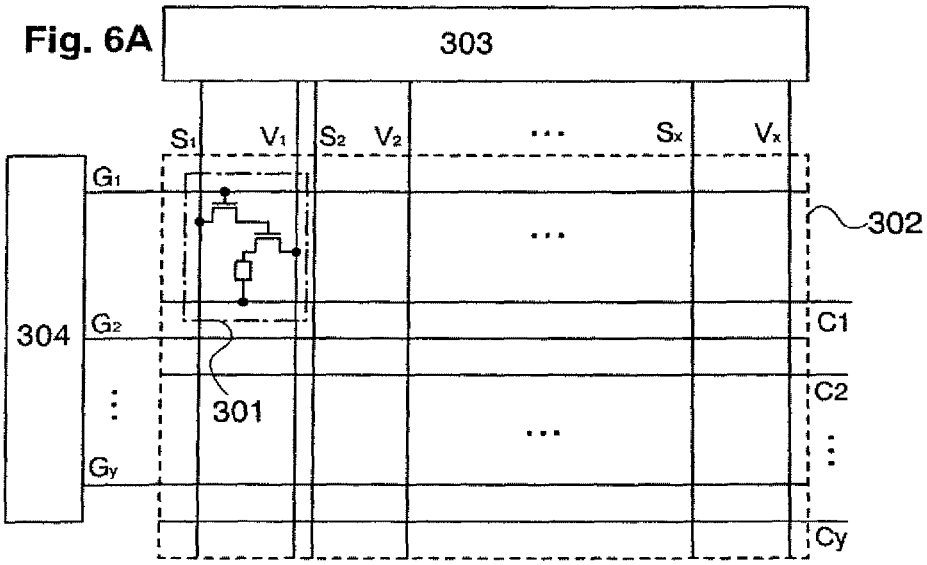
FIGS. 6A to 6C show a display device of the present invention.

FIG. 6A shows an outline of a display device to which the present invention is applied. The display device includes a pixel portion 302, a signal line driving circuit 303, and a scanning line driving circuit 304, which are located around the pixel portion 302.

The pixel portion 302 has x-signal lines $S_1$ to $S_x$ and x-power source lines $V_1$ to $V_x$ which are arranged in the column direction and y-scanning lines $G_1$ to $G_y$ and y-power source lines $C_1$ to $C_y$ which are arranged in the row direction (x and y are natural numbers). A region surrounded by each one of the signal lines $S_1$ to $S_x$, the power source lines $V_1$ to $V_x$, the scanning lines $G_1$ to $G_y$, and the power source lines $C_1$ to $C_y$ corresponds to a pixel 301. A plurality of pixels 301 are arranged in matrix in the pixel portion 302.

The signal line driving circuit 303, the scanning line driving circuit 304, and the like may be integrally formed with the pixel portion 302 on the same substrate. In addition, the signal line driving circuit 303, the scanning line driving circuit 304, and the like may be located outside the substrate on which the pixel portion 302 is formed. Further, the number of signal line driving circuits 303 and the number of scanning line driving circuits 304 are not particularly limited. The number of signal line driving circuits 303 and the number of scanning line driving circuits 304 can be arbitrarily set according to the structure of the pixel 301. Note that signals and power source potentials are supplied from the outside to the signal line driving circuit 303, the scanning line driving circuit 304, and the like through a FPC or the like (not shown). A power source circuit is connected with the power source lines $C_1$ to $C_y$. However, the power source circuit may be integrally formed with the pixel portion 302 or externally formed to be connected with the pixel portion 302 through a FPC or the like.

According to the present invention, when a potential of the power source circuit connected with one of or both a group of the power source lines $V_1$ to $V_x$ and a group of the power source lines $C_1$ to $C_y$ is corrected according to the environmental temperature, a variation in current value due to a change in temperature can be suppressed.

Note that a display panel in which a pixel portion having light emitting elements and driving circuits are sealed between a substrate and a cover material, a module and a display in which an IC and the like are mounted in the panel, and the like are included in the category of the display device of the present invention. In other words, the display device corresponds to a generic name for the panel, the module, the display, and the like.

Two typical structural examples related to the pixel 301 located at an i-column and a j-row of the pixel portion 302 will be described in detail using FIGS. 6B and 6C. The pixel 301 shown in FIG. 6B has a switching transistor 306, a driving transistor 307, and a light emitting element 308. The pixel 301 shown in FIG. 6C has a structure in which a canceling transistor 309 and a scanning line $R_j$ are added to the pixel 301 shown in FIG. 6B.

Figure 6B:
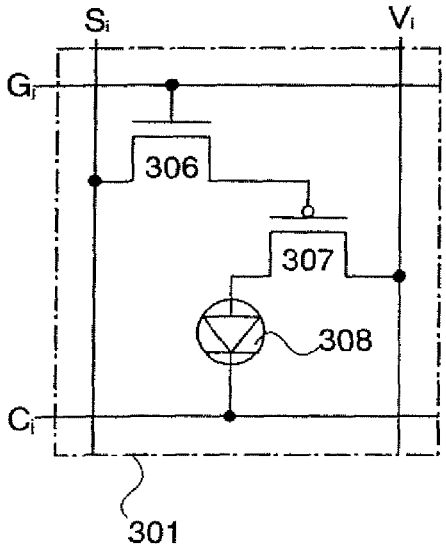
Figure 6C:
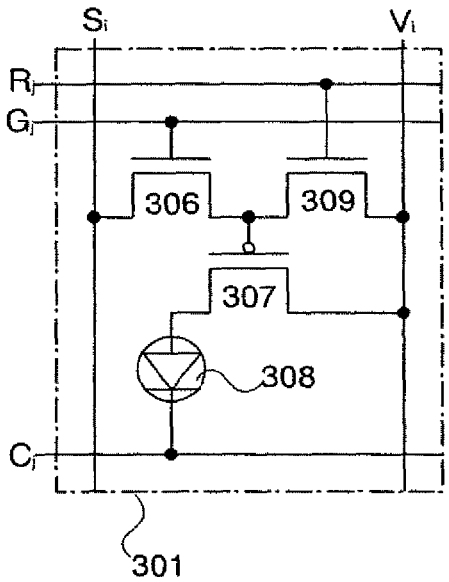

In FIGS. 6B and 6C, the gate electrode of the switching transistor 306 is connected with a scanning line $G_j$, a first electrode thereof is connected with a signal line $S_j$, and a second electrode thereof is connected with the gate electrode of the driving transistor 307. A first electrode of the driving transistor 307 is connected with a power source line $V_j$ and a second electrode thereof is connected with one electrode of the light emitting element 308. The other electrode of the light emitting element 308 is connected with a power source line $C_j$.

Also, in FIG. 6C, the switching transistor 306 and the canceling transistor 309 are connected in series and located between the signal line $S_j$ and the power source line $V_j$. The gate electrode of the canceling transistor 309 is connected with the scanning line $R_j$.

In this specification, the one electrode of the light emitting element 308 which is connected with the second electrode of the driving transistor 307 is called a pixel electrode, and the other electrode connected with the power source line $C_j$ is called a counter electrode.

In FIGS. 6B and 6C, the switching transistor 306 has a function of controlling an input signal to the pixel 301. As far as the switching transistor 306 has a function as a switch, its conductivity type is not particularly limited. Accordingly, both an n-channel type and a p-channel type can be used.

Also, in FIGS. 6B and 6C, the driving transistor 307 has a function of controlling the light emission of the light emitting element 308. The conductivity type of the driving transistor 307 is not particularly limited. However, when the driving transistor 307 is the p-channel type, the pixel electrode becomes an anode and the counter electrode becomes a cathode. In addition, when the driving transistor 307 is the n-channel type, the pixel electrode becomes a cathode and the counter electrode becomes an anode.

In FIG. 6C, the canceling transistor 309 has a function of stopping the light emission of the light emitting element 308. As far as the canceling transistor 309 has a function as a switch, its conductivity type is not particularly limited. Accordingly, a transistor having any conductivity type of an n-channel type and a p-channel type may be used.

The transistor located in the pixel 301 may have not only a single gate structure with a single gate electrode but also a multi-gate structure such as a double gate structure with two gate electrodes and a triple gate structure with three gate electrodes. In addition, the transistor may have any structure of, a top gate structure in which the gate electrode is located over a semiconductor film and a bottom gate structure in which the gate electrode is located under the semiconductor film. A capacitor element is not provided in the pixel 301 shown in FIGS. 6B and 6C. However, the present invention is not limited to this. Accordingly, a capacitor element for keeping a gate-source voltage of the transistor 307 may be located in the pixel.

This embodiment can be freely combined with Embodiments 1 to 4.

Embodiment 6

Figure 7A:
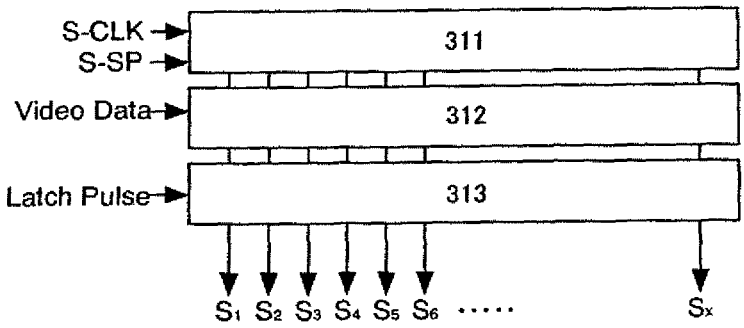
FIGS. 7A and 7B are explanatory diagrams of a signal line driving circuit and a scanning line driving circuit.
Figure 7B:
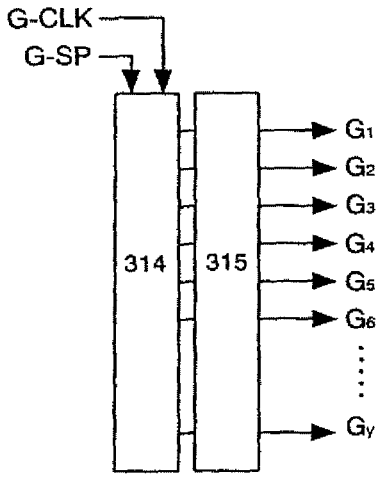

In this embodiment, the configurations and operations of a signal line driving circuit 303, a scanning line driving circuit 304, will be described with reference to the FIGS. 7A and 7B, respectively.

First, the signal line driving circuit 303 is described with reference to the FIG. 7A. The signal line driving circuit 303 has a shift register 311, a first latch circuit 312 and a second latch circuit 313.

The operation of the signal line driving circuit 303 is described briefly. The shift register 311 comprises a plurality of flip-flop circuits (FF), and is supplied with a clock signal (S-CLK), a start pulse (S-SP), and a clock inversion signal (S-CLKb). Sampling pulses are output one by one according to the timing of these signals.

The sampling pulse output from the shift register 311 is input into the first latch circuit 312. The first latch circuit 312 is supplied with digital video signals, which, in turn, are retained in each column according to the timing of the input of the sampling pulse.

In the first latch circuit 312, when the columns from the first to the last are filled with the retained video signals, a latch pulse is input into the second latch circuit 313 during a horizontal return line period. The video signals retained in the first latch circuit 312 are transferred to the second latch circuit 313, at the same time. Then, the one line of the video signals retained in the second latch circuit 313 is input into the signal lines $S_1$ to $S_x$, at the same time.

While the video signals retained in the second latch circuit 313 are being input into the signal lines $S_1$ to $S_x$, sampling pulses are again output from the shift register 311. The above operation is repeated.

Next, the scanning line driving circuit 304 is described with reference to FIG. 7B. The scanning line driving circuit 304 has a shift register 314 and a buffer 315, respectively. Briefly, the shift register 314 outputs sampling pulses one by one according to the clock signal (G-CLK), a start pulse (G-SP) and a clock inversion signal (G-CLKb). Next, the sampling pulses amplified in the buffer 315 are input into the scanning line, and the scanning line is turned to be a selected state one by one in response to the input of the sampling pulse. The pixel controlled by the selected scanning line is supplied with digital video signals from signal lines $S_1$ to $S_x$ in sequence.

A level shifter circuit may be provided between the shift register 314 and the buffer 315. By providing a level shifter circuit, the voltage amplitudes of the logic circuit part and the buffer can be altered.

This embodiment can be implemented in conjunction with embodiments 1 to 5.

Embodiment 7

In this embodiment, a driving method applied to the present invention will be briefly described.

A driving method in the case where a multi-gradation image is displayed by using a display device, is broadly divided into an analog gradation method and a digital gradation method. Both methods can be applied to the present invention. A differential point between both of the methods is a method of controlling a light emitting element in respective states of light emission and non-light emission of the light emitting element. The former analog gradation method is a method of controlling the amount of current flowing into the light emitting element to obtain gradation. The latter digital gradation method is a method of driving the light emitting element with only two states of a on-state (state in which luminance is substantially 100%) and an off-state (state in which luminance is substantially 0%).

With respect to the digital gradation method, a combination method of a digital gradation method and an area gradation method (hereinafter indicated as an area gradation method) and a combination method of a digital gradation method and a time gradation method (hereinafter indicated as a time gradation method) have been proposed in order to represent a multi-gradation image.

The area gradation method is a method of dividing a pixel into a plurality of sub-pixels and selecting light emission or non-light emission for the respective sub-pixels to represent gradation according to a difference between a light emitting area and the other area in a pixel. In addition, the time gradation method is a method of controlling a period for which a light emitting element emits light to represent gradation as reported in Japanese Patent Application Laid-open No. 2001-5426. Specifically, one frame period is divided into a plurality of sub-frame periods having different lengths and light emission or non-light emission of the light emitting element is selected for each of the periods to represent gradation according to a length of a light emitting period during the one frame period.

Both the analog gradation method and the digital gradation method can be applied to the light emitting device of the present invention. Further, both the area gradation method and the time gradation method are applicable. Still further, other than the above methods, any known driving method can be applied to the display device of the present invention.

Note that, in a display device for conducting multi-color display, a plurality of sub-pixels corresponding to respective colors of R, G, and B are provided in a pixel. With respect to the respective sub-pixels, because of a difference of current densities of respective materials for R, G, and B and a difference of transmittance of color filters therefor, there is the case where intensities of light emitted therefrom are different even when the same voltage is applied. Therefore, it is preferable that the potential of the power source line is changed for each of sub-pixels corresponding to the respective colors.

This embodiment can be arbitrarily combined with Embodiments 1 to 6.

Embodiment 8

Electronic devices to which the present invention is applied include a video camera, a digital camera, a goggles-type display (head mount display), a navigation system, a sound reproduction device (such as a car audio device and an audio set), a lap-top computer, a game machine, a portable information terminal (such as a mobile computer, a mobile telephone, a portable game machine, and an electronic book), an image reproduction device including a recording medium (more specifically, an device which can reproduce a recording medium such as a digital versatile disc (DVD) and so forth, and include a display for displaying the reproduced image), or the like. Specific examples thereof are shown in FIGS. 8A to 8H.

Figure 8A:
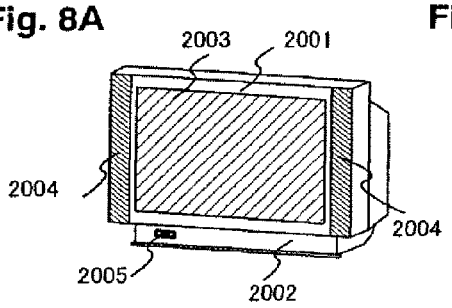
FIGS. 8A to 8H show electric devices to which the present invention is applied.

FIG. 8A illustrates a light emitting device which includes a casing 2001, a support table 2002, a display portion 2003, a speaker portion 2004, a video input terminal 2005 and the like. The present invention is applicable to the display portion 2003. The light emitting device is of the self-emission-type and therefore requires no backlight. Thus, the display portion thereof can have a thickness thinner than that of the liquid crystal display device. The light emitting device is including the entire display device for displaying information, such as a personal computer, a receiver of TV broadcasting and an advertising display.

Figure 8B:
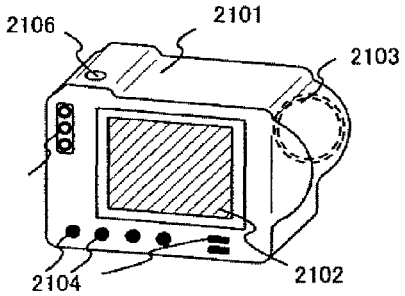

FIG. 8B illustrates a digital still camera which includes a main body 2101, a display portion 2102, an image receiving portion 2103, an operation key 2104, an external connection port 2105, a shutter 2106, and the like. The present invention can be applied to the display portion 2102.

Figure 8C:
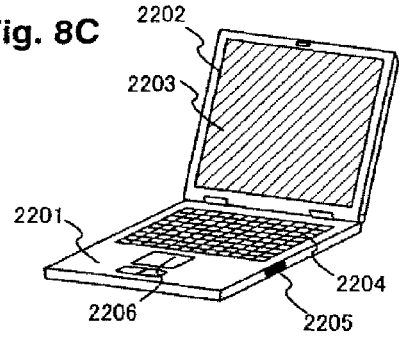

FIG. 8C illustrates a lap-top computer which includes a main body 2201, a casing 2202, a display portion 2203, a keyboard 2204, an external connection port 2205, a pointing mouse 2206, and the like. The present invention can be applied to the display portion 2203.

Figure 8D:
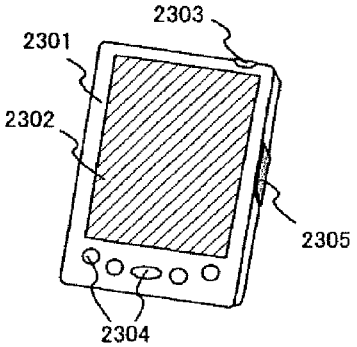

FIG. 8D illustrates a mobile computer which includes a main body 2301, a display portion 2302, a switch 2303, an operation key 2304, an infrared port 2305, and the like. The present invention can be applied to the display portion 2302.

Figure 8E:
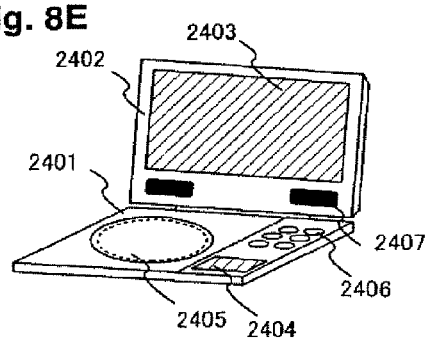

FIG. 8E illustrates a portable image reproduction device including a recording medium (more specifically, a DVD reproduction device), which includes a main body 2401, a casing 2402, a display portion A 2403, another display portion B 2404, a recording medium (DVD or the like) reading portion 2405, an operation key 2406, a speaker portion 2407 and the like. The display portion A 2403 is used mainly for displaying image information, while the display portion B 2404 is used mainly for displaying character information. The present invention can be applied to these display portions A 2403 and B 2404. The image reproduction device including a recording medium further includes a game machine or the like.

Figure 8F:
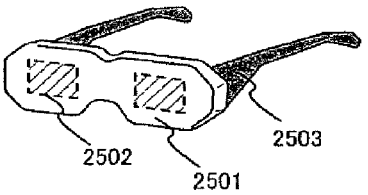

FIG. 8F illustrates a goggle type display (head mounted display) which includes a main body 2501, a display portion 2502, arm portion 2503, and the like. The present invention can be applied to the display portion 2502.

Figure 8G:
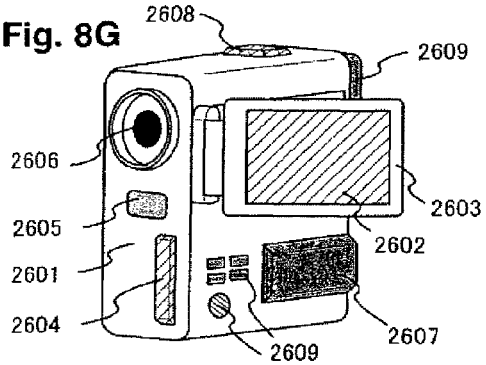

FIG. 8G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, and the like. The present invention can be applied to the display portion 2602.

Figure 8H:
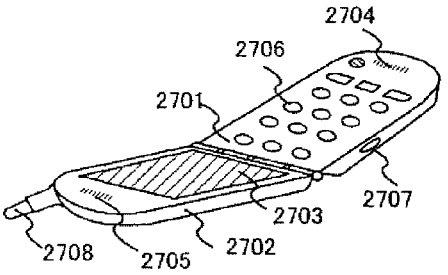
Figure 9:
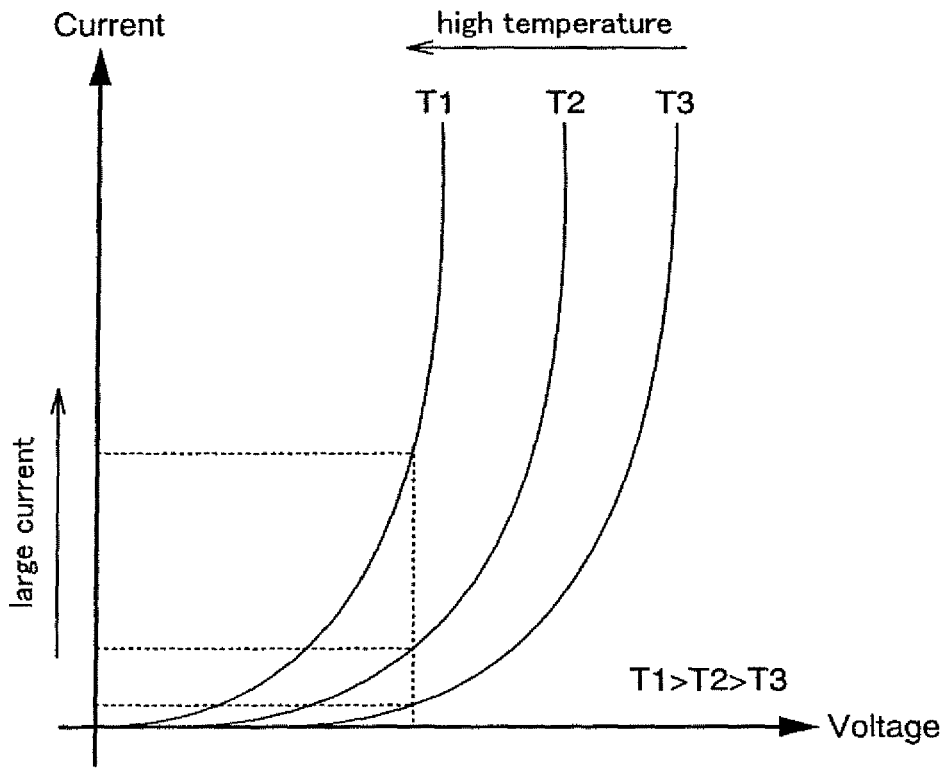
FIG. 9 is a graph showing a relationship between a voltage-current characteristic and a temperature.
Figure 10A:
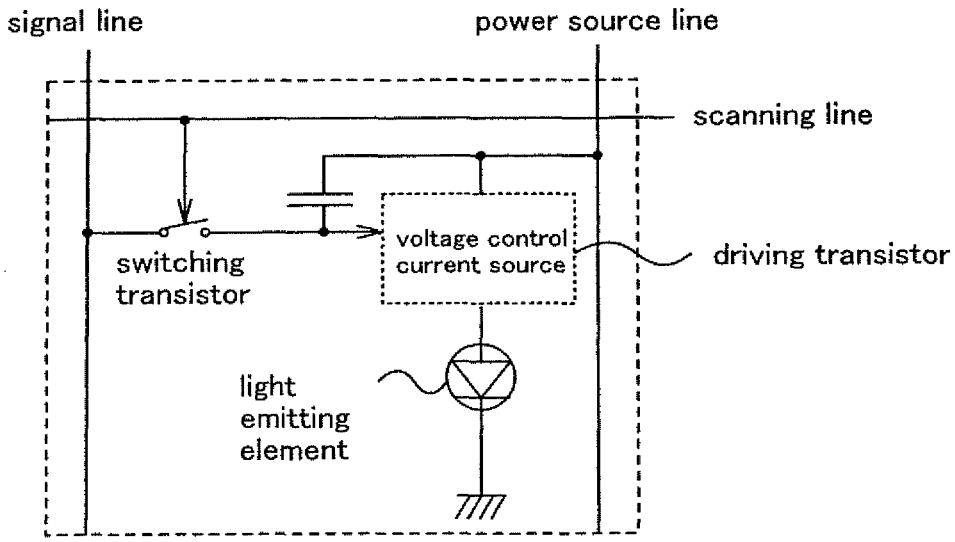
FIGS. 10A and 10B are concept diagrams of constant current drive and constant voltage drive.
Figure 10B:
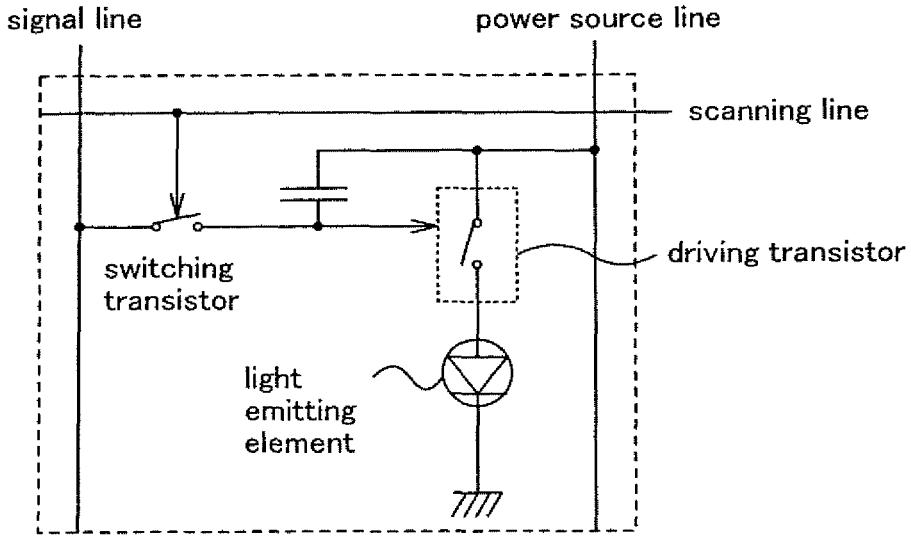

FIG. 8H illustrates a mobile telephone which includes a main body 2701, a casing 2702, a display portion 2703, a sound input portion 2704, a sound output portion 2705, an operation key 2706, an external connecting port 2707, an antenna 2708, and the like. The present invention can be applied to the display portion 2703. Note that the display portion 2703 can reduce power consumption of the mobile telephone by displaying white-colored characters on a black-colored background.

When the brighter luminance of light emitted from the light emitting material becomes available in the future, the light emitting device of the present invention will be applicable to a front-type or rear-type projector in which a light including output image information is enlarged by means of lenses or the like to be projected.

The aforementioned electronic devices are more likely to be used for display information distributed through a telecommunication path such as Internet, a CATV (cable television system), and in particular likely to display moving picture information. Since the response speed of the light emitting materials is very high, the light emitting device is preferably used for moving picture display.

A portion of the light emitting device that is emitting light consumes power, so it is desirable to display information in such a manner that the light-emitting portion therein becomes as small as possible. Accordingly, when the light emitting device is applied to a display portion which mainly displays character information, e.g., a display portion of a portable information terminal, and more particular, a mobile telephone or a sound reproduction device, it is desirable to drive the light emitting device so that the character information is formed by a light emitting portion while a non-emission portion corresponds to the background.

As set forth above, the present invention can be applied variously to a wide range of electronic devices in all fields. The electronic devices in this embodiment can be obtained by utilizing a light emitting device having a configuration in which the structures in embodiments 1 through 6 are freely combined.

According to the present invention, when the signal inputted to each pixel or the power source potential is corrected according to the environmental temperature detected by the temperature sensor, a variation in current value due to the change in temperature is suppressed, thereby providing a display device having improved reliability. In addition, according to the present invention, the operation by a user is not required. Therefore, when the correction is continued after the display device is transferred to an end user, the long life of a product can be expected.

Further, according to the present invention, the variation in current value due to not only the change in temperature but also the change with time can be suppressed. This is to use that a light emitting period of each pixel can be detected by sampling the video signal inputted to each pixel. The detection value by the counter and the data of the change with time in the brightness characteristic which is stored in advance are compared with each other, and the signal or the power source potential is corrected. As a result, according to the present invention, the video signal supplied to a deteriorated pixel can be corrected. Thus, even if a part of pixels in the pixel portion is deteriorated, the uniformity of a display screen can be kept without causing brightness unevenness.

What is claimed is:

1. A display device comprising:

a display panel comprising a plurality of pixels, the pixels being configured to display an image, and each pixel comprising a separate light emitting element;

a time compensation storage circuit configured to store in advance data of change with time in brightness characteristic of the light emitting elements in a nonvolatile memory;

a counter configured to store cumulated light emission time of each pixel in the time compensation storage circuit, the cumulated light emission time including all past time light is emitted from the pixel beginning with the first light emission of the pixel; and a correction circuit configured to correct a power source potential in accordance with the data of change with time in brightness characteristic of the light emitting elements and cumulated light emission period of each pixel, and to supply a corrected power source potential to the display panel.

2. A display device comprising:

a display panel comprising a plurality of pixels, the pixels being configured to display an image, and each pixel comprising a separate light emitting element;

a temperature detecting means configured to detect an environmental temperature;

a memory configured to store a temperature characteristic of the light emitting element;

a time compensation storage circuit configured to store in advance data of change with time in brightness characteristic of the light emitting elements in a nonvolatile memory;

a counter configured to store cumulated light emission time of each pixel in the time compensation storage circuit, the cumulated light emission time including all past time light is emitted from the pixel beginning with the first light emission of the pixel;

a correction circuit configured to correct a power source potential in accordance with the temperature characteristic stored in the memory, the environmental temperature detected by the temperature detecting means, the data of change with time in brightness characteristic of the light emitting element, and cumulated light emission period of each pixel, and to supply a corrected power source potential to the display panel.

3. A display device according to claim 1, wherein the time compensation storage circuit is configured keep on cumulating light emission time of each pixel even when the display device is switched off and on.

4. A display device according to claim 2, wherein the time compensation storage circuit is configured keep on cumulating light emission time of each pixel even when the display device is switched off and on.

5. A display device according to claim 2, wherein the temperature characteristic comprises a temperature dependency of a light emission intensity of the light emitting element.

6. A display device according to claim 2, wherein the temperature characteristic of the light emitting element is constituted by data of voltage-current characteristic versus temperature in the light emitting element.

7. A display device according to claim 1, wherein the light emitting element is an organic light emitting diode.

8. A display device according to claim 2, wherein the light emitting element is an organic light emitting diode.

9. A display device according to claim 2, wherein the temperature detecting means comprises another light emitting element.

10. A display device according to claim 1, wherein the display device is selected from the group consisting of a light emitting device, a digital still camera, a lap-top computer, a mobile computer, a portable image reproduction device, a goggle type display, a video camera and a mobile phone.

11. A display device according to claim 2, wherein the display device is selected from the group consisting of a light emitting device, a digital still camera, a lap-top computer, a mobile computer, a portable image reproduction device, a goggle type display, a video camera and a mobile phone.

12. A display device according to claim 1, further comprising a plurality of power source lines, wherein the corrected power source potential is supplied to the light emitting elements through the power source lines.

13. A display device according to claim 2, further comprising a plurality of power source lines, wherein the corrected power source potential is supplied to the light emitting elements through the power source lines.

14. A display device according to claim 1, wherein the correction circuit is configured to compensate for deterioration with time of the light emitting element as a function of the cumulated light emission time of each pixel.

15. A display device according to claim 2, wherein the correction circuit is configured to compensate for deterioration with time of the light emitting element as a function of the cumulated light emission time of each pixel.

* * * * *